United States Patent [19]

Selder

[11] 4,011,027

[45] Mar. 8, 1977

[54] STAIN REMOVAL APPARATUS

[75] Inventor: Harald Selder, Dachau, Switzerland

[73] Assignee: Escher Wyss G.m.b.H., Ravensburg, Wurttemburg, Germany

[22] Filed: Sept. 22, 1975

[21] Appl. No.: 615,527

[30] Foreign Application Priority Data

Sept. 23, 1974 Switzerland ..... 12842/74

[52] U.S. Cl. ..... 415/121 B; 415/83; 241/188 A

[51] Int. Cl.[2] ..... F01D 1/06

[58] Field of Search ..... 415/121 R, 121 B, 83; 259/DIG. 30, 49; 241/188 A, 188 R; 416/62

[56] References Cited

UNITED STATES PATENTS

| | | | |
|---|---|---|---|
| 247,206 | 9/1881 | McAuley | 241/188 R |
| 1,462,592 | 7/1923 | Bentley | 415/83 |
| 1,489,786 | 4/1924 | Povey et al. | 259/96 |
| 1,947,953 | 2/1934 | Otto | 241/188 A |
| 2,606,502 | 8/1952 | Carlson | 415/83 |
| 2,619,330 | 11/1952 | Williams | 259/96 |

FOREIGN PATENTS OR APPLICATIONS

| | | | |
|---|---|---|---|
| 113,336 | 5/1929 | Austria | 259/DIG. 30 |
| 591,968 | 1/1934 | Germany | 241/188 R |
| 796,494 | 6/1958 | United Kingdom | 415/83 |

*Primary Examiner*—Henry F. Raduazo
*Attorney, Agent, or Firm*—Kenyon & Kenyon Reilly Carr & Chapin

[57] ABSTRACT

The stain removal apparatus uses alternating rows of teeth between a rotor and the housing to clean paper pulp during passage of the paper pulp by the teeth. Check members are employed adjacent the teeth of the innermost row of teeth to preclude accumulations of material in front of the teeth. The check members are of the same thickness as the teeth at points adjacent the teeth while being shaped to merge into the rotor or housing at the end remote from the teeth.

5 Claims, 2 Drawing Figures

STAIN REMOVAL APPARATUS

Figure 1:
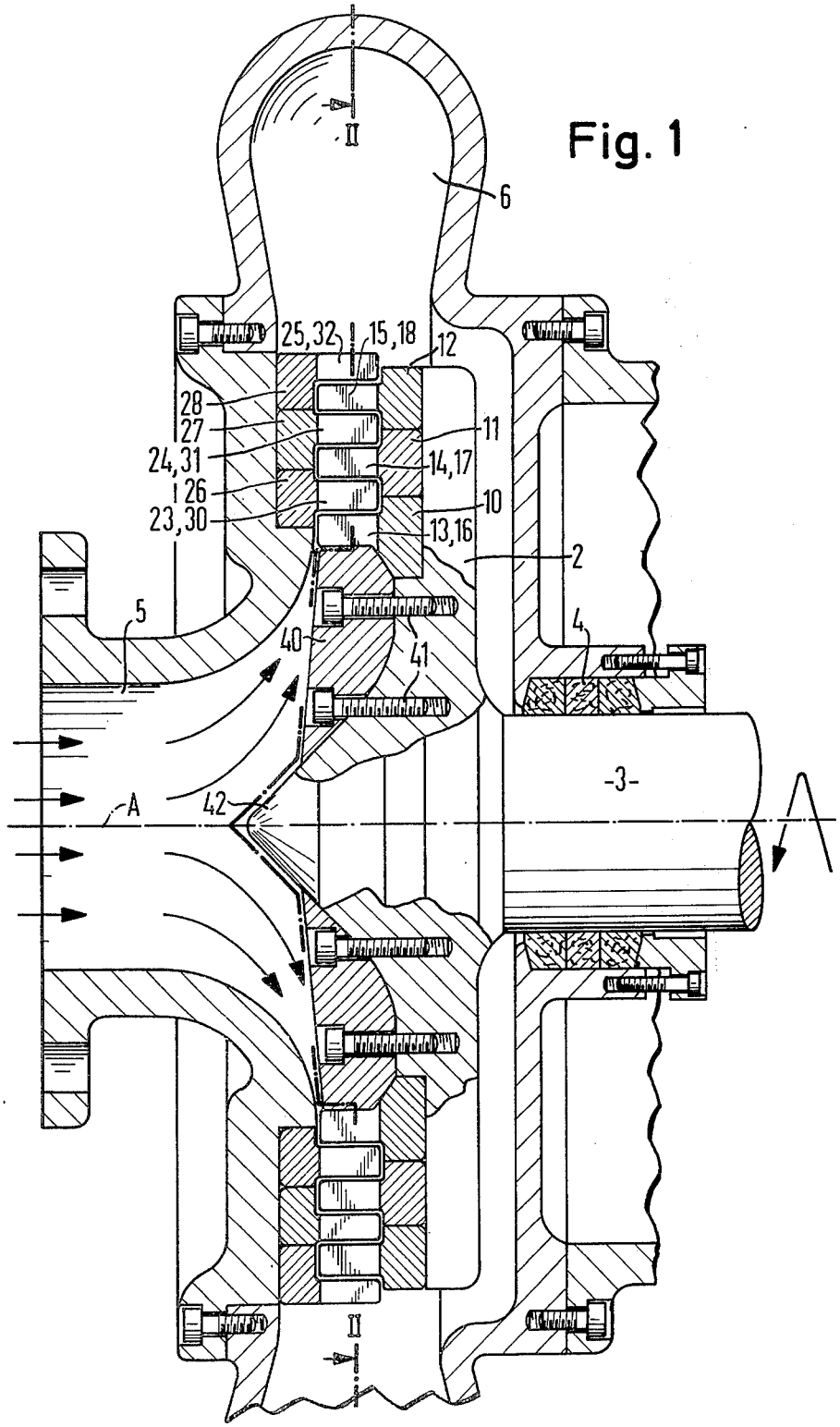

This invention relates to a stain removal apparatus and particularly to a stain removal apparatus for paper pulp.

Heretofore, various types of apparatus have been known for dissolving stains, spots or the like in paper pulp. One such apparatus employs a housing in which a rotor is rotatably mounted with concentric rows of spaced apart teeth mounted in alternating manner on both the rotor and housing in a passage between the rotor and housing. In use, a flow of paper pulp is passed into the housing and directed through the gaps between the teeth in the respective rows of teeth for cleaning purposes. However, in stain removal apparatus of this kind there is an increased risk of clogging if wet-strength waste paper, or waste paper containing plastics sheeting, is processed. That is, pieces of plastic sheeting or large specks of wet-strength paper may build up in front of the teeth of the first row and accumulate until the passage between the rotor and housing is clogged.

Accordingly, it is an object of the invention to avoid clogging of stain removal apparatus for paper pulp.

It is another object of the invention to be able to process pulp obtained from waste paper containing plastics sheeting or wet-strength waste paper without difficulty.

It is another object of the invention to provide a means of modifying existing stain removal apparatus in a simple manner to avoid clogging when processing pulp containing large particles.

Briefly, the invention is directed to stain removal apparatus for paper pulp having a housing, a rotor rotatably mounted therein, a plurality of concentric rows of spaced apart teeth on the rotor and a plurality of concentric rows of spaced apart teeth on the housing which are disposed in alternating manner with the teeth on the rotor. In accordance with the invention, a plurality of check members are mounted on either the rotor or housing to preclude an accumulation of material in front of the teeth of the innermost row of teeth. To this end, each check member is disposed adjacent a respective one of the teeth of the innermost tooth row and each check member has a cross-sectional thickness at each tooth equal to the cross-sectional thickness of the tooth thereat while merging at a point remote from the tooth into the rotor or housing.

In one embodiment, the housing includes an axial inlet for a flow of pulp and a peripherally located outlet for the outflow of processed pulp. In addition, the rotor includes a pointed hub in the region of the rotor axis which projects towards the housing inlet and, with the housing, defines a passage for directing the pulp flow to the rows of teeth. In this embodiment, the innermost row of teeth is located on the rotor while the check members are in the form of ribs on the rotor which extend from each innermost tooth to merge into the hub. The ribs may preferably be formed by inserts secured to the rotor. This not only gives a simple embodiment of the check members which can subsequently be incorporated in existing apparatus, but in addition, the pumping effect forming in the apparatus and contributing to delivery of the paper pulp is intensified.

The width of the individual inserts in the circumferential direction may be slightly larger than the width of the tooth adjoining the insert so as to form an overhang on each side of the insert relative to the remainder of the tooth.

Figure 2:
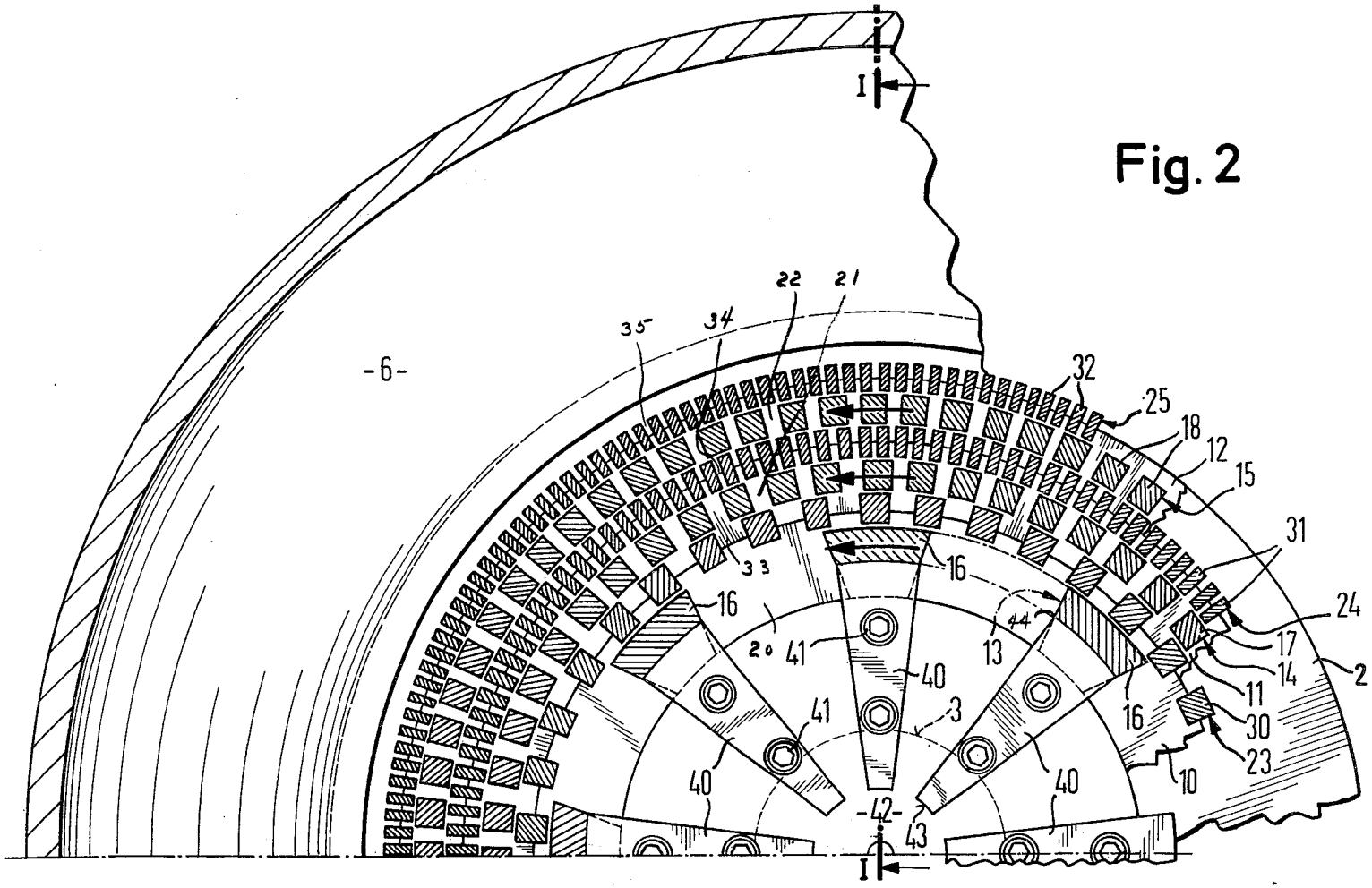

These and other objects and advantages of the invention will become more apparent from the following detailed description and appended claims taken in conjunction with the accompanying drawings in which:

FIG. 1 illustrates an axial sectional view of a stain removal apparatus according to the invention; and FIG. 2 illustrates a partial sectional view taken on line II—II of FIG. 1.

Referring to FIG. 1, an apparatus for removing stains from paper pulp comprises, in known manner, a housing 1 in which a rotor 2 is rotatably mounted via a shaft 3 on an axis of rotation A. The shaft 3 is provided with a drive (not shown) and is sealed relative to the housing 2 by a suitable seal 3. As will be apparent from FIG. 1, the housing 1 of the apparatus is constructed in the style of a pump housing and has an axial inlet 5 for receiving a flow of paper pulp and a peripherally located outlet 6 for a flow of processed pulp. This outlet extends tangentially out of the housing 1.

Three toothed rings 10, 11, 12 are secured on the rotor 2 by means (not shown) in known manner to provide concentric rows of spaced apart teeth 13, 14, 15 coaxial with the axis of rotation A of the rotor 2. As will be apparent from FIG. 2, the rows of teeth 13, 14, 15 comprise teeth 16, 17, 18 respectively, with gaps 20, 21, 22 between them. In a similar fashion, three toothed rings 26, 27, 28 are secured in the housing to provide concentric rows of teeth 23, 24, 25 disposed in alternating manner in the spaced between the rows of teeth 13, 14, 15. The rows of teeth 23, 24, 25 also consist of spaced apart teeth 30, 31, 32 with gaps 33, 34, 35 therebetween.

Referring to FIGS. 1 and 2, a plurality of check members 40 are mounted on a pointed hub 42 of the rotor 2 in order to preclude an accumulation of material in front of each tooth 16 of the innermost row 13 of teeth on the rotor 2 relative to the flow of paper pulp. To this end, each check member 40 is in the form of an insert which is detachably secured to the rotor 2 adjacent each tooth 16 by a pair of bolts 41 which are threaded into suitably tapped bores in the rotor 2. As shown in FIG. 1, each insert 40 forms a rib which leads from a tooth 16 to the pointed hub 42 of the rotor 2. The thickness of each insert 40 at each tooth 16 in a plane radial to the axis is equal to the thickness of the tooth 16 in a plane radial to the axis at that point while, at a point remote from the tooth 16, the insert 40 merges into the rotor hub 42 by narrowing down to a line 43 at the surface of the hub 42.

During operation, the inserts 40 form check members which guide the flow of pulp from the inlet 5 between the teeth 16 and in so doing prevent lumps of plastics sheeting or wet-strength paper from sticking to the end faces of the teeth 16 of the first row.

As will be seen from FIG. 2, the width of the individual inserts 40 in the circumferential direction is slightly larger, in the area adjoining the tooth 16, than the width of the tooth 16 adjoining the insert 40 at that point. A small overhang 44 thus forms at both sides of the insert 40 and prevents a projecting edge from being formed, on which pulp fibers could catch.

Although the ribs in the example illustrated have the form of inserts 40 secured by bolts 41, the ribs can also be made integrally with the rotor 2. Another possible construction is one in which the first (i.e. innermost)

row of teeth, as considered in the direction of flow, is formed by stationary teeth secured in the housing 1. In that case, the check members or ribs are secured in the housing rather than on the rotor.

What is claimed is:

1. A stain removal apparatus for paper pulp comprising a housing;

a rotor rotatably mounted in said housing on a longitudinal axis;

a plurality of concentric rows of spaced apart teeth mounted on said rotor;

a plurality of concentric rows of spaced apart teeth mounted on said housing and disposed in alternating manner with said rows of teeth on said rotor; and a plurality of check members secured to said rotor, each said check member being disposed adjacent a respective one of said teeth of the innermost row of said rows of teeth, each said check member having a thickness in a plane radial to said axis and at each respective tooth equal to the thickness of said tooth thereat in a plane radial to said axis and merging at a point remote from said tooth into said rotor.

2. An apparatus as set forth in claim 1 wherein said housing includes an axial inlet for a flow of pulp and a peripherally located outlet and wherein said rotor includes a pointed hub for directing the flow of pulp from said inlet to said rows of teeth and wherein said check member is a rib extending from a tooth of the innermost row of teeth on said rotor and merging into the surface of said hub.

3. An apparatus as set forth in claim 2 wherein each rib is an insert detachably mounted on said row.

4. An apparatus as set forth in claim 3 wherein each insert has a circumferential width larger than the width of a respective tooth at said insert to form an overhang on each side of said insert relative to the remainder of said tooth.

5. A stain removal apparatus for paper pulp comprising a housing having an outlet for receiving a flow of paper pulp, a plurality of annular concentric rows of spaced apart teeth defining gaps for the passage of paper pulp and a peripherally located outlet downstream of said teeth;

a rotor rotatably mounted in said housing on a longitudinal axis and having a plurality of rows of spaced apart teeth disposed in alternating manner with said rows of teeth on said housing; and a plurality of check members, each check member being mounted adjacent each tooth of the innermost row of said rows of teeth for precluding an accumulation of material in front of each said tooth relative to the flow of paper pulp each said check member having a thickness in a plane radial to said axis and at each respective tooth equal to the thickness of said tooth thereat in a plane radial to said axis and merging at a point remote from said tooth into one of said housing and said rotor.

* * * * *